US010471724B2

(12) United States Patent
Chover Lopez et al.

(10) Patent No.: US 10,471,724 B2
(45) Date of Patent: Nov. 12, 2019

(54) PRINTING FLUID CONTAINER

(71) Applicant: Hewlett-Packard Development Company, L.P., Houston, TX (US)

(72) Inventors: Carlos Chover Lopez, Sant Cugat del Valles (ES); Francesc Ros Cerro, Sant Cugat del Valles (ES); Joan-Albert Miravet Jimenez, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/762,991

(22) PCT Filed: Jan. 15, 2016

(86) PCT No.: PCT/EP2016/050844

§ 371 (c)(1),
(2) Date: Mar. 23, 2018

(87) PCT Pub. No.: WO2017/121493

PCT Pub. Date: Jul. 20, 2017

(65) Prior Publication Data

US 2018/0304636 A1 Oct. 25, 2018

(51) Int. Cl.
*B41J 2/175* (2006.01)

(52) U.S. Cl.
CPC ..... *B41J 2/17513* (2013.01); *B41J 2/175* (2013.01); *B41J 2/1752* (2013.01); *B41J 2/17566* (2013.01); *B41J 2/17596* (2013.01); *B41J 2/17543* (2013.01); *B41J 2/17556* (2013.01)

(58) Field of Classification Search
CPC ..... B41J 2/175; B41J 2/1752; B41J 2/17513; B41J 2/17543; B41J 2/17556; B41J 2/17566; B41J 2/17596
See application file for complete search history.

(56) References Cited

U.S. PATENT DOCUMENTS 4,178,595 A 12/1979 Jinnai et al.
4,394,669 A 7/1983 Ozawa et al.
5,039,999 A 8/1991 Winslow et al.
5,504,511 A * 4/1996 Nakajima ..... B41J 2/17513 347/86

(Continued)

FOREIGN PATENT DOCUMENTS

CN 101925466 12/2010
EP 0968829 A2 6/1999

(Continued)

OTHER PUBLICATIONS

Cooper, Keith. Northlight Images Photography Articles by Keith Cooper. Canon iPF6450/6400 SetUp. Retrieved on Dec. 11, 2015.

*Primary Examiner* — Anh T Vo
(74) *Attorney, Agent, or Firm* — HP Inc. Patent Department

(57) ABSTRACT

An example printing fluid container (100) comprising a container body (102) defining a cavity (104), and a piston (106) located within the cavity (104), is described. The piston (106) divides the cavity (104) into a first chamber (108) to receive printing fluid and a second chamber (110), fluidically isolated from the first chamber (108), to receive a positively pressurized fluid.

20 Claims, 4 Drawing Sheets

(56) References Cited

U.S. PATENT DOCUMENTS

| | | | | |
|---|---|---|---|---|
| 5,886,718 | A * | 3/1999 | Johnson | G01D 15/18 347/85 |
| 6,231,174 | B1 * | 5/2001 | Haigo | B41J 2/1652 347/89 |
| 6,428,152 | B1 * | 8/2002 | Hollands | B41J 2/17513 347/85 |
| 6,513,919 | B2 * | 2/2003 | Shyn | B41J 2/17513 347/86 |
| 6,945,640 | B2 * | 9/2005 | Cheok | B41J 2/17506 347/85 |
| 6,984,029 | B2 * | 1/2006 | Bellinger | B41J 2/17513 347/86 |
| 7,669,954 | B2 * | 3/2010 | Kojima | B41J 2/175 347/14 |
| 8,162,462 | B2 * | 4/2012 | McCracken | B21K 1/24 137/533 |
| 8,388,120 | B2 * | 3/2013 | Shin | B41J 2/17509 347/85 |
| 8,500,258 | B2 * | 8/2013 | Esdaile-Watts | B41J 2/175 347/6 |
| 9,102,157 | B2 | 8/2015 | Prothon et al. | |
| 2002/0047882 | A1 | 4/2002 | Karlinski et al. | |
| 2002/0145650 | A1 | 10/2002 | Pan et al. | |
| 2004/0027430 | A1 | 2/2004 | Anderson et al. | |
| 2005/0024397 | A1 | 2/2005 | Mizoguchi | |
| 2009/0295888 | A1 | 12/2009 | Nitta et al. | |
| 2010/0295905 | A1 | 11/2010 | Tamaki | |
| 2010/0302325 | A1 | 12/2010 | Shin et al. | |
| 2011/0025770 | A1 | 2/2011 | Rosati et al. | |
| 2013/0106963 | A1 | 5/2013 | Kawase | |
| 2013/0293640 | A1 | 11/2013 | McCallum et al. | |
| 2015/0375518 | A1 | 12/2015 | Sugitani et al. | |

FOREIGN PATENT DOCUMENTS

| | | | |
|---|---|---|---|
| EP | 2292432 | A1 | 3/2011 |
| EP | 2759408 | A1 | 7/2014 |
| GB | 2077662 | A | 12/1981 |
| WO | WO-2006075314 | A2 | 7/2006 |
| WO | WO-2007050174 | A1 | 5/2007 |
| WO | WO-2012121693 | A1 | 9/2012 |

* cited by examiner

PRINTING FLUID CONTAINER

BACKGROUND

Some printing systems have a reservoir to store printing fluid, such as ink, and a supply system to supply the printing fluid from the reservoir to a printhead, to enable the printhead to apply the printing fluid to a substrate to form an image on the substrate during a printing operation. In some printing systems, the supply system comprises additional storage, intermediate the reservoir and the printhead. The additional storage may provide a buffer of printing fluid to enable the reservoir to be refilled or changed during a printing operation.

BRIEF DESCRIPTION OF THE DRAWINGS

Various features of the present disclosure will be apparent from the detailed description which follows, taken in conjunction with the accompanying drawings, which together illustrate, by way of example, features of the present disclosure, and wherein.

DETAILED DESCRIPTION

In the following description, for purposes of explanation, numerous specific details of certain examples are set forth. Reference in the specification to "an example" or similar language means that a particular feature structure, or characteristic described in connection with the example is included in at least that one example, but not necessarily in other examples.

In an example, a printing fluid container comprises a container body defining a cavity, and a piston located within the cavity, the piston dividing the cavity into a first chamber to receive printing fluid and a second chamber, fluidically isolated from the first chamber, to receive a positively pressurized fluid.

Figure 1:
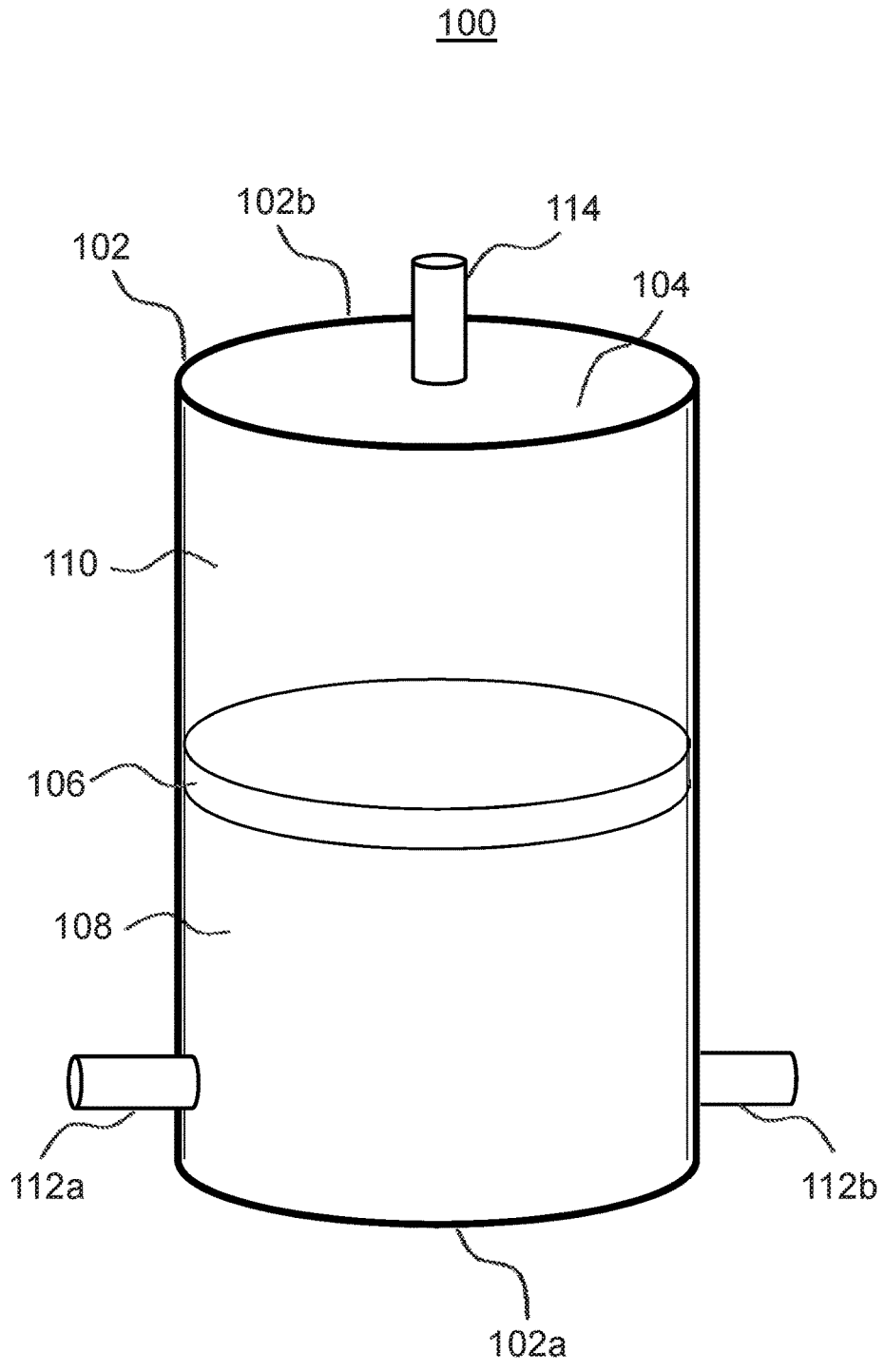
FIG. 1 is a schematic diagram of a printing fluid container according to an example.

FIG. 1 schematically illustrates the components of a printing fluid container 100 according to an example. The container 100 comprises a container body 102 defining a cavity 104. In the example shown in FIG. 1, the container body 102 is cylindrical; however, it will be understood that the container body 102 may be other shapes in other examples. For example, in some examples, the container body 102 may be cubical. The container body 102 has a first end 102*a* and a second end 102*b*. In the example shown in FIG. 1, the first end 102*a* is a lower end and the second end 102*b* is an upper end. However, in some examples, the first end 102*a* may be an upper end and the second end 102*b* may be a lower end. In other examples, the first end 102*a* and the second end 102*b* may be at the same level.

Within the container body 102 is a piston 106 that divides the cavity 104 into two chambers: a first chamber 106 and a second chamber 110. The second chamber 110 is fluidically isolated from the first chamber 108 by the piston 106. For example, the piston 106 may comprise a gasket, O-ring, or other suitable seal which may, for example, help prevent leakage of fluid from the first chamber 108 to the second chamber 110 and from the second chamber 110 to the first chamber 108.

The piston 106 is slidably movable within the cavity 104. Movement of the piston 106 towards the first end 102*a* reduces a volume of the first chamber 108 with a corresponding increase in a volume of the second chamber 110. Similarly, movement of the piston 106 towards the second end 102*b* reduces the volume of the second chamber 110 with a corresponding increase in the volume of the first chamber 108.

By providing the piston 106 within the cavity 104, a volume of the first chamber 108 can be varied without the shape of the container 100 changing. This may, for example, increase the life of the container 100 since it is not subjected to material fatigue that may deteriorate a flexible container.

The construction of the printing fluid container 100 facilitates variation of the volume of printing fluid contained in printing fluid container 100 while minimizing fatigue of the material from which the printing fluid container 100 is manufactured, which may, for example, provide a robust container. This in turn may, for example, provide a container with comparably increased operating life and may utilize comparably less maintenance.

The construction of the printing fluid container 100 may, for example, also facilitate use of the printing fluid container 100 in a range of printers or printing applications requiring different volumes of printing fluid for printing events.

In use, the container body 102 and the piston 106 isolate printing fluid within the first chamber 108 from the second chamber 110 and the exterior of the printing fluid container 100. This may, for example, prevent contamination or degradation of the printing fluid. For example, where the printing fluid is a de-gassed ink, air is prevented from coming into contact with the ink and causing it to degrade. This in turn may, for example, reduce the likelihood of degraded printing fluid damaging a printhead.

The container body 102 comprises a printing fluid inlet 112*a* and a printing fluid outlet 112*b*. The printing fluid inlet 112*a* is to transmit printing fluid into the first chamber 108. The printing fluid outlet 112*b* is to transmit printing fluid out of the first chamber 108.

The container body 102 further comprises a positively pressurized fluid inlet, referred to herein as an air inlet 114, to transmit positively pressurized fluid into the second chamber 110. The positively pressurized fluid may be a liquid or a gas. In an example, the fluid may be air.

The printing fluid container 100 may be constructed using any suitable material. In an example, the printing fluid container 100 may be constructed using plastics materials. In another example, the printing fluid container 100 may be constructed using metal.

The printing fluid container 100 depicted in FIG. 1 may be used as an intermediate printing fluid container in a printing system. For example, a printing system may comprise a printing fluid reservoir and a printhead, and the container 100 may be located intermediate the reservoir and the printhead. In use, the first chamber 108 may contain printing fluid received from the reservoir and may dispense printing fluid to the printhead. The container 100 thereby acts as a buffer for printing fluid such that when the reservoir is depleted of printing fluid during a printing operation, the printing operation may continue while the reservoir is refilled or replaced. Use of the printing fluid container 100 in this way may be referred to as "hot swapping". In some examples, a printing system may comprise plural printing fluid reservoirs and plural printheads with plural printing fluid containers 100 intermediate the reservoirs and the printheads.

In an example, a printing fluid, apparatus comprises a printing fluid chamber to receive a variable amount of positively pressurized printing fluid, a fluid level detector to generate a signal indicative of an amount of printing fluid in the printing fluid chamber, and a printing fluid pump to pump printing fluid into the printing fluid chamber on the basis of the signal generated by the fluid level detector.

Figure 2:
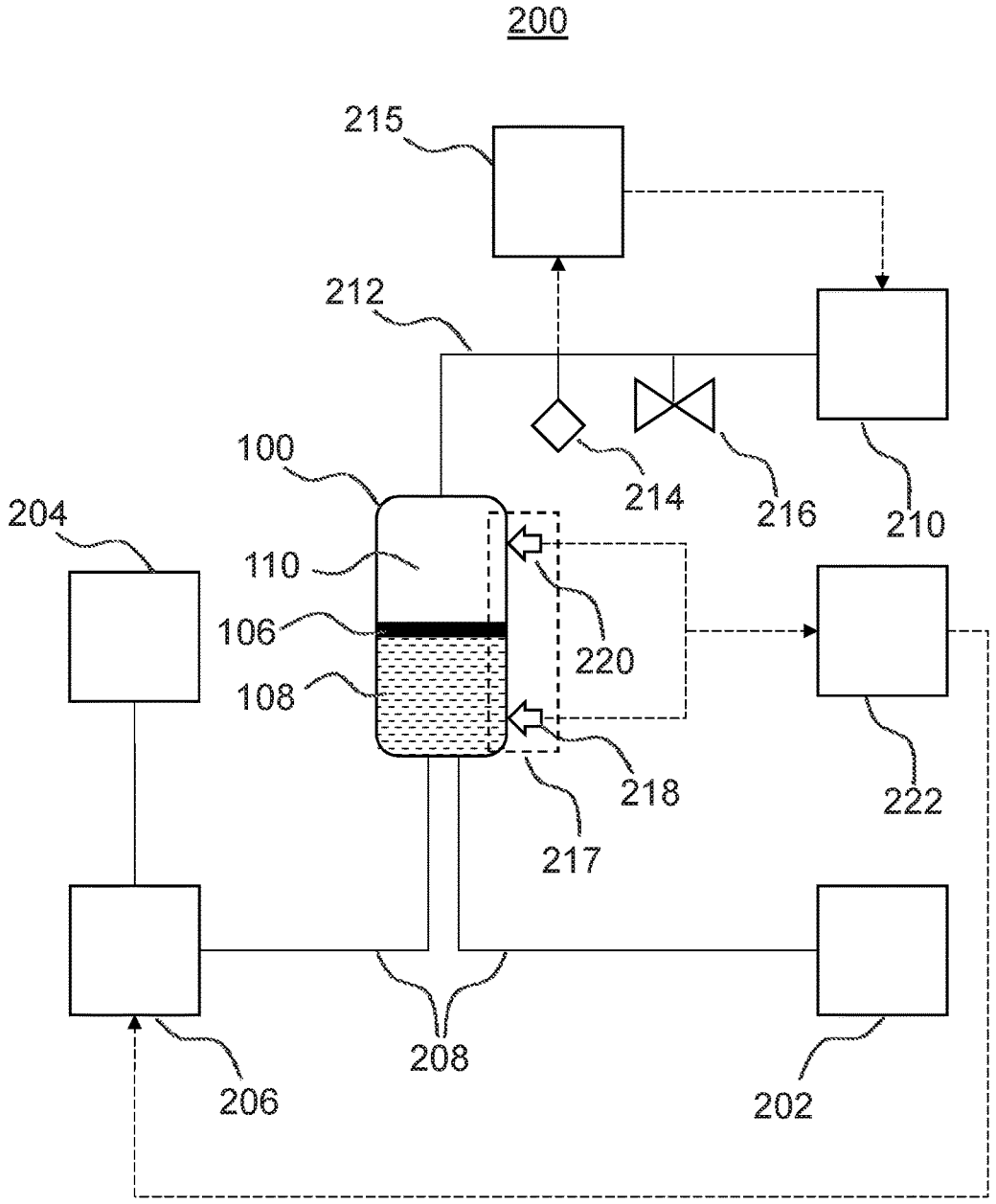
FIG. 2 is a schematic diagram of a printing fluid apparatus according to an example and FIG. 2A illustrates a similar apparatus with an additional fluid level sensor according to variation of this example.

FIG. 2 schematically illustrates an example of a printing fluid apparatus 200. The printing fluid apparatus 200 comprises a printing fluid container such as the printing fluid container 100 described above with reference to FIG. 1, in use, the first chamber 108 of the printing fluid container 100 may be fluidically connected via the first fluidic connector 112 to a printhead 202. The first chamber 108 of the printing fluid container 100 may also be fluidically connected via the first fluidic connector 112 to a printing fluid supply 204. In an example, the printing fluid supply 204 may be an ink cartridge storing a supply of printing fluid.

Printing fluid may be pumped from the printing fluid supply 204 to the first chamber 108 by a pump, referred to herein as the printing fluid pump 206, in some examples, the first chamber 108 and the printing fluid pump 206 may be located along a printing fluid supply line 208 fluidically connecting the printing fluid supply 204 to the printhead 202.

In an example, the printing fluid pump 206 comprises a check valve to prevent printing fluid returning to the printing fluid supply 204 under the action of pressure provided by pressurized fluid in the second chamber 110. In another example, a check valve may be provided elsewhere along the printing fluid supply line 208 between the printing fluid supply 204 and the printing fluid inlet 112*a*. For example, a check valve may be provided at the printing fluid inlet 112*a*.

In some examples, the printing fluid supply line 208 may comprise a mechanism to help prevent leakage of printing fluid when the printing fluid supply 204 is removed for replacement. For example, the printing fluid supply line 208 may comprise a valve which closes to seal the printing fluid supply line 208 when the printing fluid supply 204 is removed.

The second chamber 110 of the printing fluid container 100 may be fluidically connected via the second fluidic connector 114 to a supply of pressurized fluid. For example, as shown in FIG. 2, a pump providing pressurized fluid, referred to herein as an air pump 210, may, be fluidically connected via the second fluidic connector 114 to the second chamber 110.

In use, positively pressurized fluid provided by the air pump 210 to the second chamber 110 exerts a force on the piston 106, which in turn pressurizes printing fluid in the first chamber 108 to cause printing fluid to flow to the printhead 202.

The second chamber 110 may be fluidically coupled to the air pump 210 via an air supply line 212. In some example, a pressure sensor 214 may be provided in the air supply line 212 to measure a pressure of pressurized fluid in the air supply line 212. In some examples, an alternative or additional pressure sensor may be provided to measure a pressure of pressurized fluid in the second chamber 110.

In some examples, the printing fluid apparatus 200 may comprise a pressure controller 215 to receive a signal indicative of a pressure of positively pressurized fluid in the second chamber 110. For example, the pressure controller 215 may receive a signal from the pressure sensor 214 located in the air supply line 212.

The pressure controller 215 may generate a control signal to control the pump 210 on the basis of the signal from the pressure sensor 214. For example, the pressure controller 215 may regulate the operation of the air pump to, maintain the pressure of pressurized fluid in the second chamber 110 at a desired pressure.

In some examples, the air supply line 212 may comprise a pressure relief valve 216, which may release pressurized fluid from the air supply line 212 if the pressure of the pressurized fluid exceeds a threshold pressure.

The printing fluid apparatus 200 may comprise a fluid level detector 217 to generate a signal indicative of an amount of printing fluid in the first chamber 108. For example, the fluid level detector 217 may detect a proximity of the piston 106.

In an example, the fluid level detector 217 comprises a first fluid level sensor 218 to generate a first fluid level signal to indicate that there is a first amount of printing fluid in the first chamber 108, and a second fluid level sensor 220 to generate a second fluid level signal to indicate that there is a second amount of printing fluid in the first chamber 108, different to the first amount of printing fluid. For example, the first fluid level sensor 218 may be to detect when the amount of printing fluid in the first chamber 108 reaches a minimum threshold and the second fluid level sensor 220 may be to detect when the amount of printing fluid in the first chamber 108 reaches a maximum threshold.

In some examples, the printing fluid apparatus 200 may comprise a fluid level controller 222 to receive a signal indicative of an amount of printing fluid in the first chamber 108. For example, the fluid level controller 222 may receive a signal from the fluid level detector 217. In some examples, the fluid level controller 222 may receive a signal from the first sensing device 218 when the amount of printing fluid in the first chamber 108 reaches a minimum threshold and may receive a signal from the second sensing device 220 when the amount of printing fluid in the first chamber 108 reaches a maximum threshold.

Although the fluid level controller 222 is described herein as a separate component to the pressure controller 215, in some examples the fluid level controller 222 and the pressure controller 215 may be a single controller.

The printing fluid pump 206 may pump printing fluid into the first chamber 108 on the basis of a signal generated by the fluid level detector 217. In an example, the fluid level controller 222 may activate the printing fluid pump 206 in response to a signal received from the first fluid level sensor 218. The fluid level controller 222 may deactivate the printing fluid pump 206 in response to a signal received from the second fluid level sensor 220.

Although the fluid level detector 217 described with reference to FIG. 2 comprises two fluid level sensors, in some examples, the fluid level detector 217 may comprise one fluid level sensor.

Figure 2A:
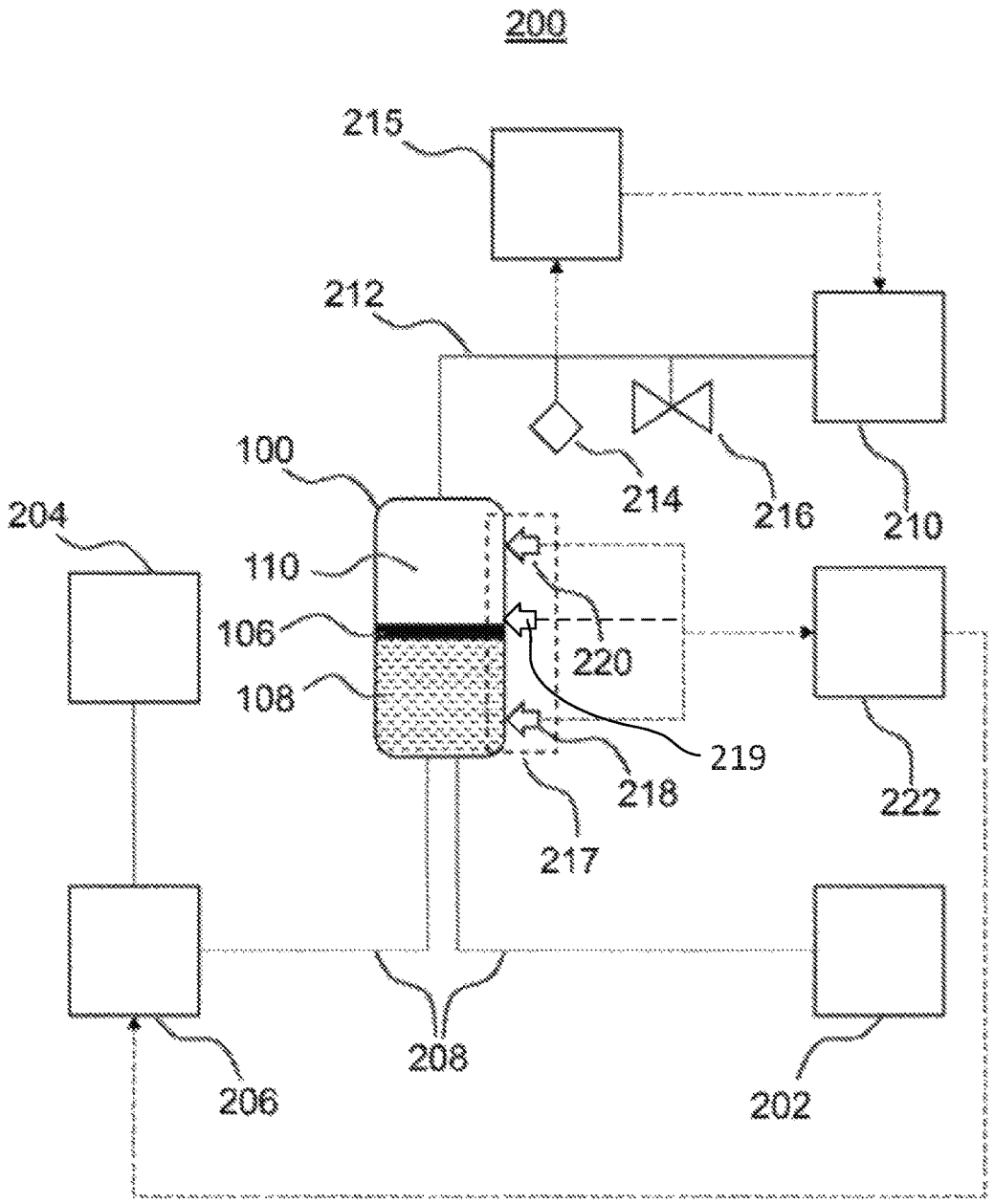

In some examples, the fluid level detector 217 may comprise more than two fluid level sensors each to generate a signal indicative of a different amount of printing fluid in the first chamber 108. For example, as shown in FIG. 2A, the fluid level detector may include a third fluid level sensor (219) to generate a third fluid level signal indicative of a third amount of printing fluid in the printing fluid chamber, the third amount of printing fluid being intermediate first and second amounts of printing fluid. This may, for example, facilitate more precise control of the amount of printing fluid in the printing fluid container. For example, the rate at which printing fluid is pumped into the printing fluid container 100 may be scaled according to a detected amount of printing fluid in the printing fluid container 100.

Figure 3:
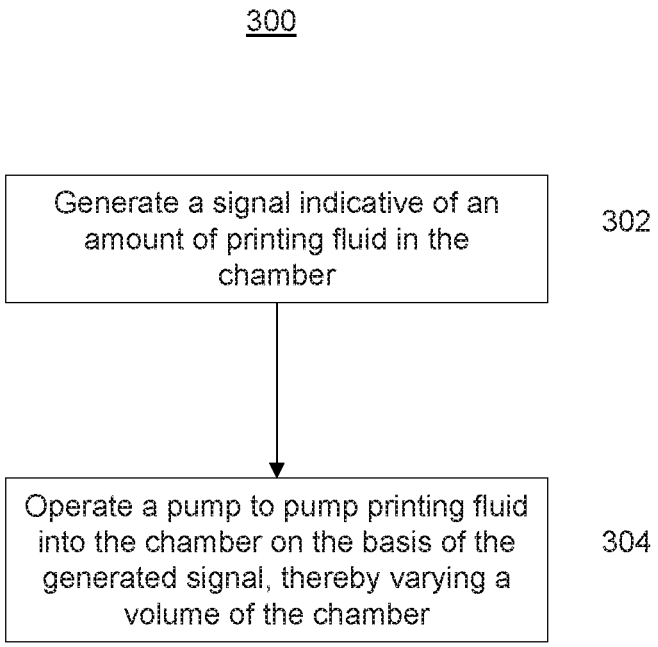
FIG. 3 is a flow diagram illustrating a method of operating a printing fluid apparatus according to an example.

FIG. 3 is a flow diagram illustrating a method 300 of operating a printing fluid apparatus comprising a chamber to receive a variable amount of positively pressurized printing fluid, according to an example.

At block 302, a signal indicative of an amount of printing fluid in the chamber is generated by a sensor. For example, the signal may be generated by the fluid level detector 217 described above with reference to FIG. 2.

At block 304, a pump to pump printing fluid into the chamber is operated on the basis of the signal generated at block 302, thereby varying a volume of the chamber. In an example, the sensor may comprise a first sensing device 218 and a second sensing device 220, as described above with reference to FIG. 2. In such an example, the pump may be activated in response to a first signal to indicate that there is a first amount of printing fluid in the chamber and deactivated in response to a second signal to indicate that there is a second amount of printing fluid in the chamber, different to the first amount of printing fluid. For example, the pump may be activated when an amount of printing fluid in the chamber reaches a minimum threshold and deactivated when an amount of printing fluid in the chamber reaches a maximum threshold.

In an example, printing fluid may be supplied from the printing fluid container 100 to a printhead, causing the piston 106 to move towards the first end 102*a* and depleting an amount of printing fluid in the first chamber 108. When the piston 106 is in proximity of the first sensing device 21$, the fluid level controller 222 may activate the printing fluid pump 206 to pump printing fluid into the first chamber 108 and cause the piston to move away from the first end 102*a*, against the pressure provided by the positively pressurized fluid in the second chamber 110, and toward the second end 102*b*. When the piston 106 is in proximity of the second sensing device 220, the fluid level controller 222 may deactivate the printing fluid pump 206 to cause the piston 106, under the action of the positively pressurized fluid in the second chamber 110, to move towards the first end 102*a* again depleting an, amount of printing fluid in the first chamber 108. This process cycle may continue iteratively throughout a printing operation, in some examples, the printing fluid supply 204 may be disconnected from the printing fluid supply line 208 during this cycle without interrupting the printing operation.

Any feature described in relation to any one example may be used alone, or in combination with other features described, and may also be used in combination with a feature or features of any other of the examples, or any combination of any other of the examples. Furthermore, equivalents and modifications not described above may also be employed.

What is claimed is:

1. A printing fluid apparatus comprising:

a printing fluid chamber to receive a variable amount of positively pressurized printing fluid;

a piston slidably disposed in the printing fluid chamber to divide the chamber into two sections, the sections each having a variable volume based on position of the piston in the chamber;

a fluid level detector to generate a signal indicative of an amount of printing fluid in the printing fluid chamber;

a printing fluid pump to pump printing fluid into a first section of the printing fluid chamber on the basis of the signal generated by the fluid level detector; and a second fluid pump to pump a second fluid into a second section of the printing fluid chamber to move the piston.

2. A printing fluid apparatus according to claim 1, wherein the second fluid pump is an air pump to pump air into the second section of the printing fluid chamber.

3. A printing fluid apparatus according to claim 1, comprising a pressure controller to control the second pump on the basis of a pressure signal indicative of a pressure of positively pressurized fluid provided to the second section of the printing fluid chamber.

4. A printing fluid apparatus according to claim 3, wherein the pressure controller is to maintain the positively pressurized fluid at a predetermined pressure.

5. A printing fluid apparatus according to claim 1, wherein the fluid level detector comprises:

a first fluid level sensor to generate a first fluid level signal to indicate that there is a first amount of printing fluid in the chamber; and a second fluid level sensor to generate a second fluid level signal to indicate that there is a second amount of printing fluid in the chamber, different to the first amount of printing fluid.

6. A printing fluid apparatus according to claim 5, comprising a fluid level controller to activate the printing fluid pump in response to the first fluid level signal and to deactivate the printing fluid pump in response to the second fluid level signal.

7. A printing fluid apparatus according to claim 5, wherein the fluid level detector comprises a third fluid level sensor to generate a third fluid level signal indicative of a third amount of printing fluid in the printing fluid chamber, the third amount of printing fluid being intermediate the first and second amounts of printing fluid.

8. A printing fluid apparatus according to claim 1, wherein the fluid level detector is to generate a signal indicative of the amount of printing fluid by detecting a proximity of the piston to a sensor of the fluid level detector.

9. A printing fluid apparatus according to claim 1, wherein the piston moves horizontally within the printing fluid chamber.

10. A printing fluid apparatus according to claim 1, further comprising a check valve to prevent printing fluid from returning to a printing fluid supply.

11. A printing fluid apparatus according to claim 1, further comprising a valve to seal a printing fluid supply line through which the printing fluid pump pumps the printing fluid to the printing fluid chamber from a printing fluid supply so that the printing fluid supply can be replaced when the valve is closed.

12. A printing fluid apparatus according to claim 1, further comprising a pressure sensor in a second fluid supply line to measure pressure of the second fluid being pumped by the second fluid pump through the second fluid supply line.

13. A printing fluid apparatus according to claim 12, further comprising a pressure controller to control the second fluid pump based on output of the pressure sensor.

14. A printing fluid apparatus according to claim 12, further comprising a pressure relief valve in the second fluid supply line to release pressure when a pressure detected by the pressure sensor exceeds a threshold pressure.

15. A method of operating a printing fluid apparatus, the printing fluid apparatus comprising a chamber to receive a variable amount of positively pressurized printing fluid, the method comprising:

generating a signal indicative of an amount of printing fluid in the chamber;

operating a pump to pump printing fluid into the chamber on the basis of the generated signal; and applying pressure to the printing fluid in the chamber by pumping, with a second pump, a second fluid into the chamber, the chamber being separated by a piston into a first section containing the printing fluid and a second section containing pressurized fluid delivered by the second pump, the piston applying pressure to the printing fluid under influence of the piston and pressurized fluid in the second section acting on the piston.

16. A method according to claim 15, comprising:

activating the pump to pump printing fluid into the chamber in response to a first signal to indicate that there is a first amount of printing fluid in the chamber; and deactivating the pump in response to a second signal to indicate that there is a second amount of printing fluid in the chamber, different to the first amount of printing fluid.

17. A printing fluid container comprising:

a container body defining a cavity;

a piston located within the cavity, the piston dividing the cavity into a first chamber to receive printing fluid and a second chamber, fluidically isolated from the first chamber, to receive a positively pressurized fluid; and a fluid level detector to indicate a level of printing fluid in the first chamber based on proximity of the piston to a sensor of the fluid level detector.

18. A printing fluid container according to claim 17, comprising a printing fluid inlet and a printing fluid outlet, the printing fluid inlet and the printing fluid outlet each being in fluid communication with the first chamber.

19. A printing fluid container according to claim 17, comprising a fluid inlet in fluid communication with the second chamber.

20. A printing fluid container according to claim 17 further comprising:

a printing fluid pump to pump printing fluid into the first chamber based on a signal generated by the fluid level detector; and a second fluid pump to pump fluid into the second chamber to move the piston.

* * * * *